US006213484B1

(12) United States Patent
Rohner

(10) Patent No.: US 6,213,484 B1
(45) Date of Patent: Apr. 10, 2001

(54) SKATEBOARD WITH A FOOT BRAKE

(76) Inventor: Patrick Rohner, Alte Landstrasse 158, CH-8800 Thalwil (CH)

( * ) Notice: Subject to any disclaimer, the term of this patent is extended or adjusted under 35 U.S.C. 154(b) by 0 days.

(21) Appl. No.: 09/319,703

(22) PCT Filed: Dec. 11, 1997

(86) PCT No.: PCT/CH97/00464

§ 371 Date: Aug. 18, 1999

§ 102(e) Date: Aug. 18, 1999

(87) PCT Pub. No.: WO98/25677

PCT Pub. Date: Jun. 18, 1998

(30) Foreign Application Priority Data

Dec. 12, 1996 (CH) ..... 3059/96

(51) Int. Cl.[7] ..... B62M 1/00

(52) U.S. Cl. ..... 280/87.042; 280/87.05

(58) Field of Search ..... 280/87.041, 87.042, 280/11.2, 87.021, 87.01, 87.05, 47.37; 188/19, 9

(56) References Cited

U.S. PATENT DOCUMENTS

| | | | | |
|---|---|---|---|---|
| 1,056,357 | * | 3/1913 | Murdock | 280/87.042 |
| 1,145,485 | * | 7/1915 | Hughes | 280/87.041 |
| 1,213,454 | * | 1/1917 | Brown | 280/87.042 |
| 1,530,165 | * | 3/1925 | Fowler | 280/87.041 |
| 1,890,755 | * | 4/1932 | Shepard | 280/87.041 |
| 2,027,254 | * | 1/1936 | Vogt | 280/87.041 |
| 2,330,147 | * | 9/1943 | Rodriguez | 280/87.041 |
| 3,751,062 | * | 8/1973 | White, Sr. | 280/87.041 |
| 4,061,351 | * | 12/1977 | Bangle | 280/87.041 |
| 4,166,519 | * | 9/1979 | Maloney | 280/11.2 X |
| 4,166,629 | * | 9/1979 | List | 280/87.041 X |
| 4,179,134 | * | 12/1979 | Atkinson | 280/11.2 X |
| 4,398,734 | * | 8/1983 | Barnard | 280/87.041 X |
| 4,707,884 | * | 11/1987 | Chang | 280/87.041 X |
| 5,853,182 | * | 12/1998 | Finkle | 280/87.042 |

FOREIGN PATENT DOCUMENTS

| | | | | |
|---|---|---|---|---|
| 598843 | * | 5/1978 | (CH) . | |
| 616854 | * | 4/1980 | (CH) . | |
| 2717927 | * | 11/1978 | (DE) . | |
| 300650 | * | 1/1989 | (EP) . | |
| 2551417 | * | 3/1985 | (FR) . | |
| 2564411 | * | 11/1985 | (FR) . | |
| 2607089 | * | 5/1988 | (FR) | 280/87.041 |
| 95/34461 | * | 12/1995 | (WO) . | |

* cited by examiner

*Primary Examiner*—Brian L. Johnson
*Assistant Examiner*—Bryan Fischmann
(74) *Attorney, Agent, or Firm*—Wenderoth, Lind & Ponack, L.L.P.

(57) ABSTRACT

A skateboard having a board, rollers attached to the bottom of the board, a steering element extending upwardly from the board, and a brake for stopping movement of the skateboard. Flexible elements are provided between the bottom of the board and the mountings of the rollers in order to allow for greater controllability of the board. The steering element is provided with a constraining element that allows the steering element to be pivoted and held in an upright position, and then pivoted to a folded condition. The brake includes a bent wire that is biased away from the rollers, and can be forced into contact with the rollers. A hook is provided on the steering element for attachment with the brake to allow for easy storage and transportation of the skateboard. Alternatively, the steering element can be pivoted into a recess in the skateboard.

12 Claims, 3 Drawing Sheets

SKATEBOARD WITH A FOOT BRAKE

BACKGROUND OF THE INVENTION

The invention relates to a skateboard and a foot brake therefor.

Conventional skateboards consist of an elongated board and normally two pairs of rollers, of which one pair is secured to the under side of the board at the rear part thereof, and the other at front part thereof. A drawback of these known skateboards is that a beginner has considerable difficulties in learning to ride such a board. As a rule, this learning involves a few falls and the corresponding risk of injury.

In a skateboard according to French Patent FR-A-2 564 411, a three-part board is provided, which has at the front and back, respectively, an elevated board part and a central board part therebetween, on which the user may stand. These three board parts are connected to each other by way of tubular frame. This necessitates a complicated manufacture, and with it a limited support surface for the user is provided.

A known skateboard according to U.S. Pat. No. 4,707,884 is equipped with a hand-bar, which is fixed to the front of the board via a joint such that it can extend in an upright position, and can be folded down onto the board. With this skateboard, a person standing on the board can hold onto this hand-bar, but he/she cannot use this hand-bar as a control lever, because no flexible members are provided in the mounting of the pairs of rollers. Furthermore, since the pairs of rollers are located below the board, the board should not be articulated, or only to a very limited extent, at right angles to is longitudinal extent with respect to these pairs of rollers. Otherwise the board would touch the rollers, which could lead to falling of the person riding on this board.

In the skateboard according to German Patent DE-U-8 517,109, a short board is provided, which offers only a limited foot support surface for a user. The rear pair of rollers is located below this short board, due to which this board cannot be articulated, or only to a very limited extent, at right angles to its longitudinal extent with respect to this pair of rollers.

In a further known skateboard according to U.S. Pat. No. 4,179,134, secured to the front side of a skateboard with two pairs of rollers is an upwardly extending flat bar, which at the upper end is provided with horizontal handles on both sides. For securing this flat bar to the board, the bar is bent at the bottom and at this bent portion is secured to the board by means of a second flat bar arranged parallel thereto. This type of attachment is relatively complicated and therefore expensive to manufacture.

This skateboard is further provided with a wheel brake, which can be actuated by means of a hand brake located on the flat bar below the handles. This hand brake is connected by way of a cable or the like to a brake lever pivoting on the under side of the board, with the brake lever acting on the rear wheels at the time of braking. This brake likewise has a complicated construction.

SUMMARY OF THE INVENTION

In comparison therewith, it is an object of the present invention to provide a skateboard according to the aforementioned type, which has a simple construction, and therefore is economical to produce, so that this skateboard can be converted into a compact state for transportation. This skateboard also offers the guarantee of improved rideability, in particular for a beginner. Furthermore, the skateboard is equipped with a simple brake, which is reliable in operation.

The object is achieved according to the invention due to the fact that a longitudinal element or steering element is kept in a pivotable position by means of a joint located above the board, and can be fastened in an upright position by a retaining device.

Thus, a person who is unpracticed is able to ride on a skateboard. In addition, this longitudinal or steering element has the advantage that the skateboard can be controlled by a corresponding pivoting movement of the longitudinal element at right angles to the direction of travel, and thus any change of direction can be undertaken. It is therefore suitable as an extremely practical means of travel, which can be carried without problems and without requiring a great deal of space on public transport or the like.

The longitudinal element is enabled to be pivoted by a joint located in the front region of the board. By means of this joint the longitudinal element may be tilted parallel to the board or lowered into a recess provided in the board. Thus this skateboard can be carried very easily and it can also be used in a conventional manner.

As a further construction according to the invention, this skateboard comprises a foot brake operating in conjunction with the rear pair of rollers, by means of which foot brake a further improvement of skateboarding safety is guaranteed.

Embodiments of the invention as well as further advantages thereof are described in detail hereafter with reference to the drawings, in which:

DESCRIPTION OF THE PREFERRED EMBODIMENTS

Figure 1:
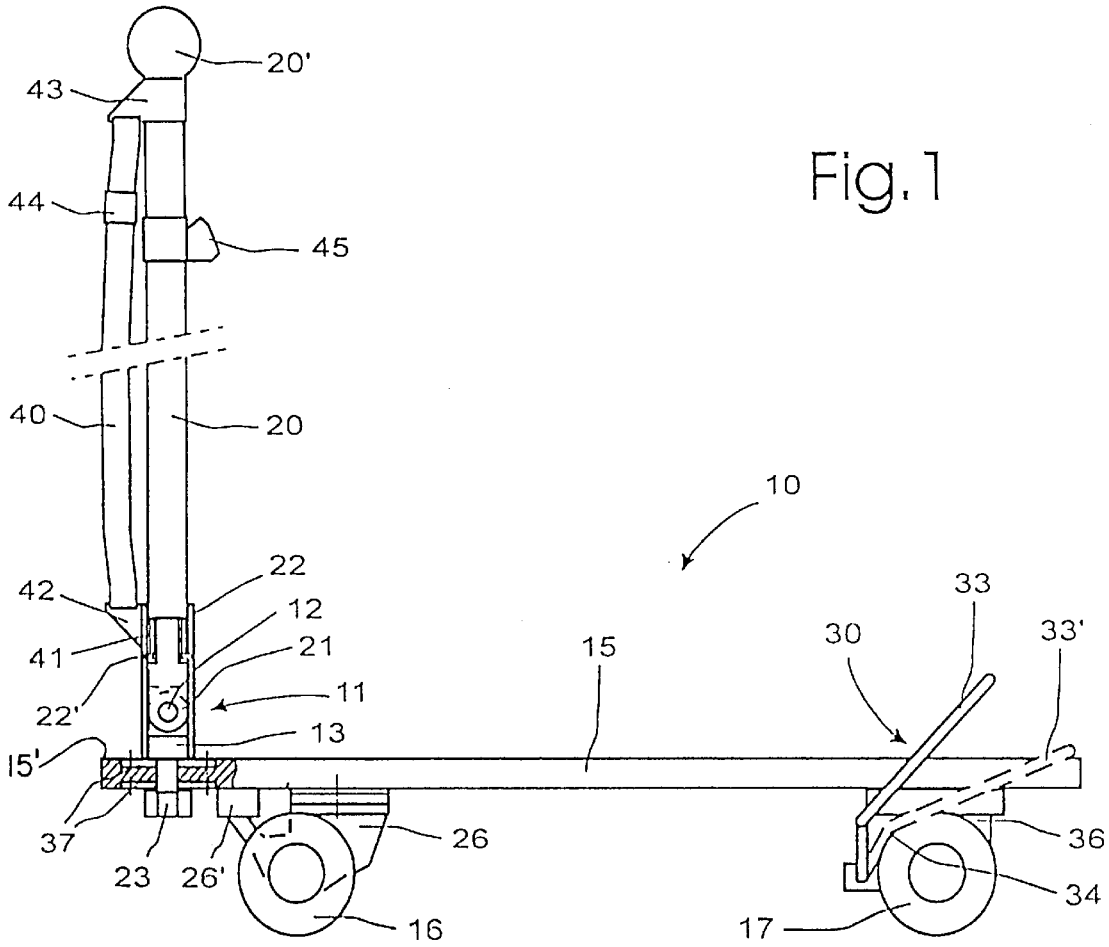
FIG. 1 is a side view with partial sectional illustration of a skateboard according to the invention.

FIG. 1 shows a skateboard 10 with a board 15 having a conventional shape, on the under side of which two pairs of rollers are mounted to rotate. These pairs of rollers 16, 17, arranged with the axes parallel to each other, are located respectively approximately at the front and the rear end of the board 15. These pairs of rollers 16, 17 consist respectively of two rollers 16, 17 and an axle connecting the rollers of each pair to one another. Each axle is mounted to rotate respectively on a retaining part 26, 36 fastened to the under side of the board 15.

According to the invention, secured to the front side 15' of the board 15 is a longitudinal element 20 held on the board and extending upwards with respect to the board, which element has such a length that a person on this skateboard 10 can remain in an upright position by grasping this longitudinal element 20. The longitudinal element 20 is therefore appropriately constructed in the form of a bar having at the upper end thereof a holding knob 20' or the like. This longitudinal element 20 is in this case retained on a joint 11 located directly above the board 15. This joint 11 comprises a joint pin 13 fastened in the board 15 by means of a screw connection 23 or the like, a matching joint fork 21 formed at the lower end of the longitudinal or steering element 20, as well as a transverse bolt 12 connecting the joint pin to the longitudinal or steering element 20. To reinforce the board 15, washers 37 supporting the pin 13 provided, which are fastened to the board 15 by way of screws.

Provided as the retaining device is a sleeve 22 surrounding the longitudinal element 20 and being axially displaceable thereon, which in the retained state surrounds in a form-locking manner both the lower part of the vertical longitudinal element 20 as well as the joint pin 13 projecting above the board, such that the longitudinal element 20 is fixed with respect to the board 15. Advantageously, this sleeve 22 is biased downward with its inner ring 22' by a spring 41 or the like, in order that the sleeve 22 does not slide automatically upward during travel.

Advantageously, the mountings of the pairs of rollers 16, 17 are equipped with flexible members, for example rubber rings, and in addition with corresponding bearings 26', in order that these pairs of rollers have a limited articulation at least at right angles with respect to the board. As a result, when riding this skateboard 10, due to corresponding hand pressure on the longitudinal element 20 at right angles to the direction of travel, the flexible members become compressed such that the skateboard is caused to travel along a curved path. This additionally improves the skateboarding properties of the skateboard.

A belt 40, which can be adjusted in length by means of a retaining part 44, is appropriately held on a flap 42 on the sleeve 22, which belt extends to the upper end of the longitudinal element 20 at which point it is held on a flap 43. This belt arrangement makes it possible to pull the sleeve 22 upward without the rider having to bend to do so.

Figure 2:
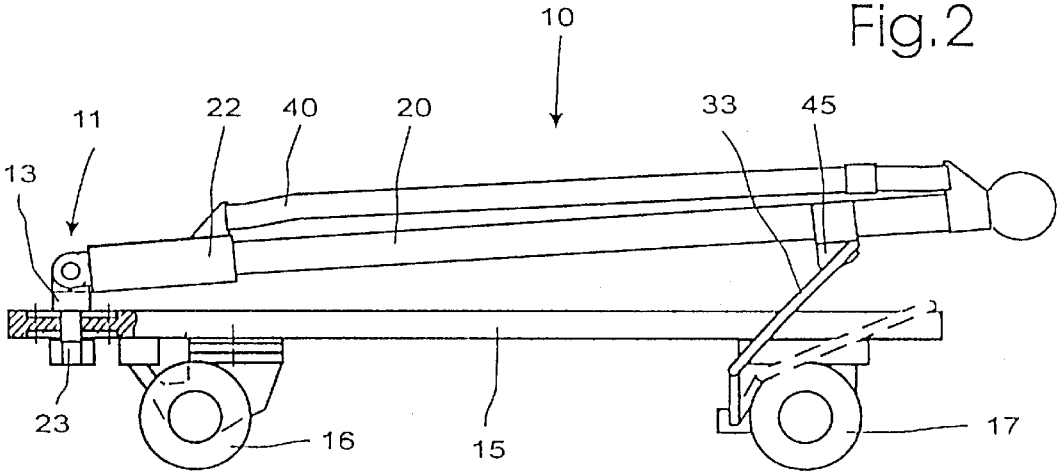
FIG. 2 is a side view of the skateboard according to FIG. 1, in which a longitudinal element is shown in a retracted state.

According to FIG. 2, after sleeve 22 is pulled up, the longitudinal element 20 can be swung down onto the board 15. As a further advantage within the scope of the invention, an engagement hook 45 is fastened to the longitudinal element 20, which hook is positioned with respect to a lever 33 of a brake 30 so that when the longitudinal element 20 is swung downwards, the hook 45 engages this lever 33 and then the skateboard 10 can be grasped by hand and hung via the belt 40 on the rider's shoulder. The skateboard 10 can be carried in a compact arrangement in this position. Also, this longitudinal element 20 can be disengaged from the lever 33 by pushing the lever downwards, whereby the lever tilts downwards and is released from the hook 45.

Figure 3:
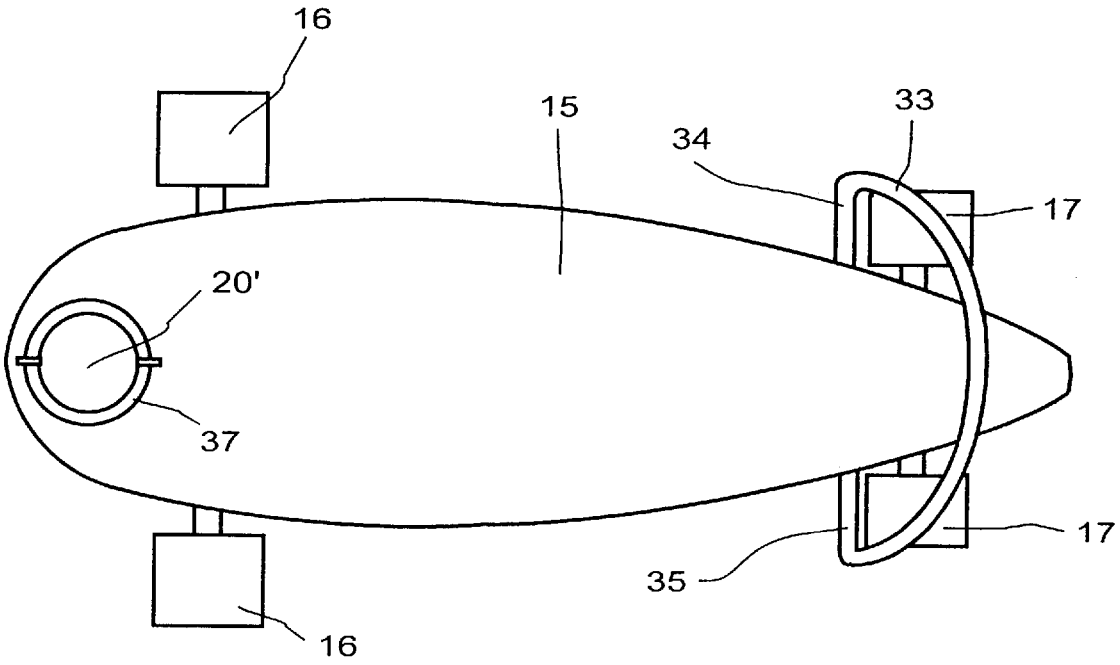
FIG. 3 is a plan view of the skateboard according to FIG. 1.

FIG. 3 is a plan view of the skateboard 10 with the longitudinal element swung upwards. According to the invention, the front as well as the rear rollers 16, 17 are arranged to project laterally from the board 15 so that the board 15 is able to tilt at right angles to its longitudinal extent by a certain angle, without coming into contact with the rollers 16, 17. Due to this tilting of the board 15, steering with a change of direction can be produced.

Figure 4:
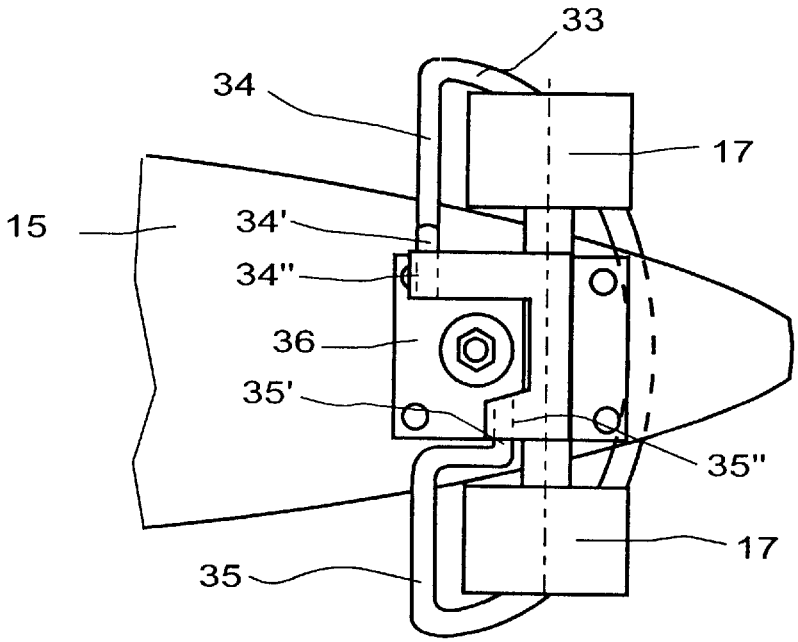
FIG. 4 is a view from below of the foot brake and of the rear pair of rollers of the skateboard according to FIG. 1.

According to FIG. 4, the foot brake operating in conjunction with the rear pair of rollers 17 is located on the rear part of the board 15. This foot brake 30 has as an essential component the brake lever 33 advantageously made from a bent steel wire, which extends above the board 15, transversely thereacross, and on both sides of the board to the under side thereof. The brake lever 33 is pivotally mounted on the retaining part 36 of the rear pair of rollers 17. The brake lever 33 may be pressed from the initial position, by foot pressure, into a braking position 33' as shown in FIG. 1.

This brake lever 33 is bent on the under side of the board 15 in such a way that its two ends 34', 35' are inserted in boards 34", 35" in a retaining pat 36, which bores are staggered with respect to each other and arranged parallel to the wheel axle. These bores 34", 35" are respectively located at the same distance from the board 15. The U-shaped lever 33 is flexible to a limited extent. Due to the staggered arrangement of the two ends 34', 35' with respect to each other, it is ensured that in the unloaded state illustrated, the lever 33 always moves back from the two rollers 17 into an initial position.

Furthermore, the lever 33 is bent so that it forms brake parts 34, 35 extending parallel to the rollers, which parts 34, 35 in the braking position 33', come into contact with the rollers, and accordingly exerts a corresponding braking action on the respective rollers. These brakes 34, 35 act simultaneously and by the same contact pressure on the rollers 17.

Figure 5:
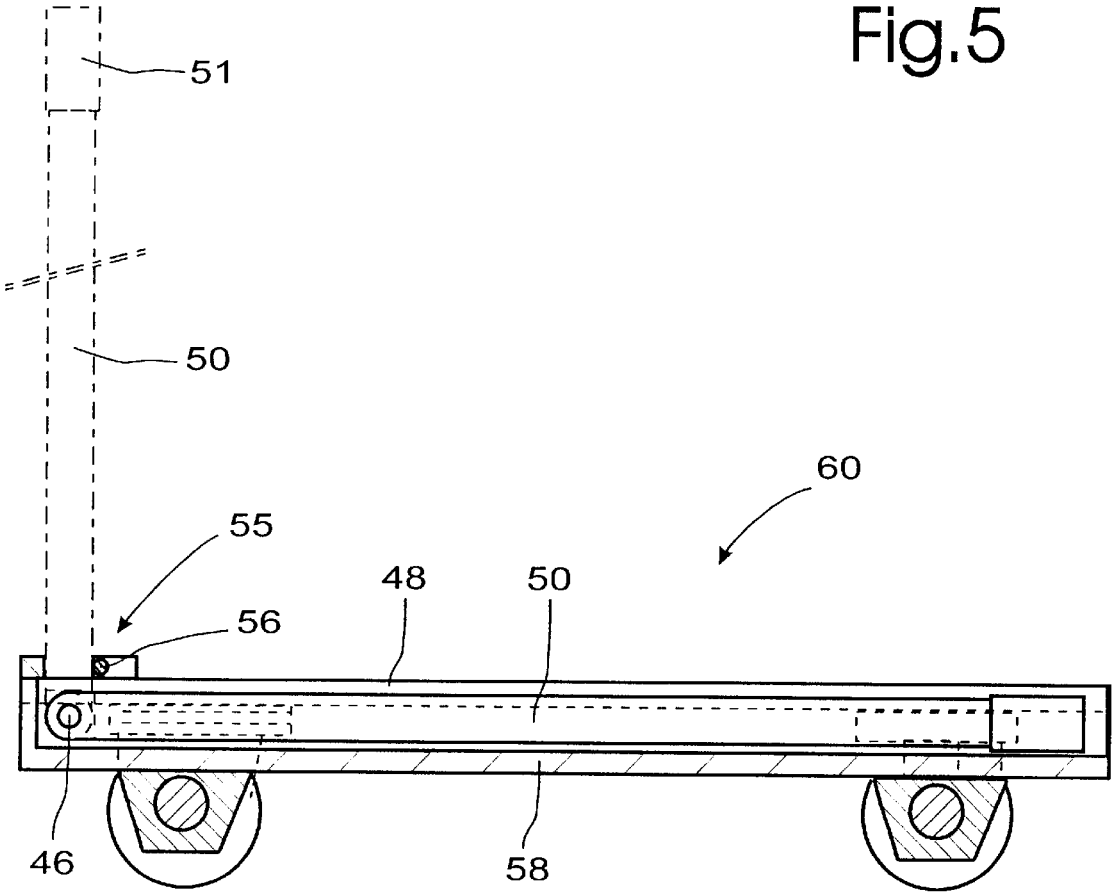
FIG. 5 shows a variation of a skateboard in longitudinal, section.

FIG. 5 also shows a variation of a skateboard 60 according to the invention, in which a recess 48 for receiving a longitudinal or steering element 50 is provided in the board 58. This recess 48 is preferably formed in the board 58 along its center and has such a depth that the longitudinal element 50 can be received therein. For this purpose, on the front side of the skateboard the longitudinal element 50 is pivotably held in this recess by a hinge pin 46. In the countersunk position of the longitudinal or steering element 50, this skateboard 60 can be used in the conventional manner. In the erect position of the longitudinal element 50, once again comprising a handle 51 at the upper end, the element can be fixed by way of a retaining device 55 illustrated diagrammatically. This retaining device comprises, for example, a bolt 56 displaceably guided on the board 58, which in the position illustrated retains the longitudinal element 50 in its erect position, and by pushing it back releases the longitudinal element 50 for folding down.

The invention is adequately illustrated with the above embodiments. Naturally further variations could be added, for example the longitudinal element could be releasably fastened directly to the board by means of a wing nut or a snap closure.

In principle, the foot brake 30 according to the invention could also be used for a normal skateboard without the longitudinal element 20.

What is claimed is:

1. A skateboard, comprising:

a board having a top side, an under side, a front portion, a rear portion, and a longitudinal axis passing through the front portion and the rear portion;

at least two pairs of rollers attached to said under side of said board;

a steering element pivotally attached to said front portion of said board, wherein the steering element is pivotable from a first portion to a second portion;

a sleeve for maintaining said steering element in said first portion, wherein the sleeve is slidable along said steering element;

a joint pin attached to said front portion of said board, the joint pin having a part extending above said board to which said steering element is pivotally attached, wherein said sleeve maintains said steering element in said first portion when said sleeve surrounds said part of said joint pin extending above said board, and wherein said sleeve allows said steering element to be pivoted to said second position when said sleeve is not surrounding said part of said joint pin extending above said board; and a member for biasing said sleeve to a position, in which said sleeve surrounds said part of said joint pin extending above said board.

2. The skateboard of claim 1, and further comprising a brake, and a hook on said steering element, wherein when said steering element is in said second position said hook engages said brake.

3. The skateboard of claim 1, wherein said at least two pairs of rollers include a front pair and a rear pair each projecting laterally from said board, and further comprising a brake in operable association with said rear pair, the brake comprising a bent wire having:

first and second segments pivotally connected to said under side of said board in a longitudinally offset and parallel arrangement with respect to one another; and a third segment interconnecting said first and second segments and extending around said board, wherein the longitudinally offset and parallel arrangement of said first and second segments causes said third segment to be biased to a first position spaced from said rear pair of rollers, and when a force is applied against this bias said third segment pivots to a second position into engagement with said rear pair of rollers.

4. The skateboard of claim 3, and further comprising a hook on said steering element, wherein when said steering element is in said second position said hook engages said third segment.

5. A skateboard, comprising:

a board having a top side with a recess therein, and under side, a front portion, and a rear portion;

at least two pairs of rollers attached to said under side of said board; and a steering element pivotally attached to said front portion of said board at a location between said top side and said bottom side of said board, wherein the steering element is pivotable from a first position to a second position in which it is received within said recess.

6. A skateboard, comprising:

a board having a top side, an under side, a front portion, a rear portion, and a longitudinal axis passing through the front portion and the rear portion;

at least two pairs of rollers attached to said under side of said board;

a brake;

a steering element having an engaging portion thereon, the steering element being pivotally attached to said front portion of said board, such that the steering element is pivotable from a first position to a second position at which said engaging portion engages said brake.

7. The skateboard of claim 6, wherein said engaging portion is a hook.

8. The skateboard of claim 7, wherein said brake comprises a bent wire having:

first and second segments pivotally connected to said under side of said board in a longitudinal offset and parallel arrangement with respect to one another; and a third segment interconnecting said first and second segments and extending around said board, wherein the longitudinal offset and parallel arrangement of said first and second segments causes said third segment to be biased to a first position spaced from said rear pair of rollers, and when a force is applied against this bias said third segment pivots to a second position into engagement with said rear pair of rollers.

9. A skateboard, comprising:

a board having a top side, and under side, a front portion, a rear portion, and a longitudinal axis passing through the front portion and the rear portion;

at least two pairs of rollers attached to said under side of said board;

and a brake in operable association with one of said pairs of rollers, said brake comprising:

(i) first and second segments connected to said under side of said board; and (ii) a third segment interconnecting said first and second segments, wherein said third segment extends around said board.

10. The skateboard of claim 9, wherein said at least two pairs of rollers include a front pair and a rear pair each projecting laterally from said board, and wherein said first, second and third segments are portions of a bent wire with said first and second segments being in a longitudinally offset and parallel arrangement with respect to one another such that:

the longitudinally offset and parallel arrangement of said first and second segments causes said third segment to be biased to a first position spaced from said rear pair of rollers, and when a force is applied against this bias said third segment pivots to a second position into engagement with said rear pair of rollers.

11. The skateboard of claim 10, and further comprising a steering element attached to said front portion of said board.

12. The skateboard of claim 11, wherein said steering element is pivotally attached to said front portion of said board.

* * * * *